US008776772B1

(12) United States Patent
Albanese

(10) Patent No.: US 8,776,772 B1
(45) Date of Patent: Jul. 15, 2014

(54) ACCESSORY FOR AN ARCHERY BOW

(76) Inventor: Nicola Albanese, Flemington, NJ (US)

( * ) Notice: Subject to any disclaimer, the term of this patent is extended or adjusted under 35 U.S.C. 154(b) by 0 days.

(21) Appl. No.: 13/337,430

(22) Filed: Dec. 27, 2011

(51) Int. Cl.
*F41B 5/00* (2006.01)

(52) U.S. Cl.
USPC ..... 124/88; 124/86; 124/89

(58) Field of Classification Search
USPC ..... 124/23.1, 25.6, 86, 88, 89
See application file for complete search history.

(56) References Cited

U.S. PATENT DOCUMENTS

| | | | |
|---|---|---|---|
| 3,572,312 | A | 3/1969 | Foster |
| 3,599,621 | A | 8/1971 | Scrobell |
| 4,787,361 | A | 11/1988 | Vyprachticky |
| 4,836,177 | A | 6/1989 | Williams |
| 4,976,250 | A | 12/1990 | Jeffrey |
| 5,137,008 | A | 8/1992 | Taylor |
| 5,349,937 | A | 9/1994 | Burling |
| 5,464,002 | A | 11/1995 | Lavoie et al. |
| 5,531,211 | A | 7/1996 | Wilfong, Jr. |
| 5,853,000 | A | 12/1998 | Torgerson et al. |
| 6,173,707 | B1 | 1/2001 | Howell et al. |
| 7,748,369 | B2 | 7/2010 | Chee |
| 7,954,175 | B2 | 6/2011 | Platt |
| 2012/0174904 | A1* | 7/2012 | Greenhoe ..... 124/89 |

* cited by examiner

*Primary Examiner* — John Ricci

(57) ABSTRACT

An accessory for an archery bow has a C-shaped forearm brace attached to the distal end of a support. The support can be supported on the bow. The brace extends arcuately around a forearm axis at least 180° in order to partially encompass a forearm. The support is mounted in an arcuate slot in the brace and extends outwardly, transverse to the forearm axis. The support can be adjusted to allow angular and linear translation of the forearm brace relative to an adjustment axis that is parallel to the forearm axis. The forearm brace is circumferentially repositionable along the support. The support may be a post with a bearing surface skewed relative to a plane perpendicular to the longitudinal axis. This post may have on opposite sides of the bearing surface, a pair of walls that straddle a peripheral portion of the forearm brace.

17 Claims, 4 Drawing Sheets

ACCESSORY FOR AN ARCHERY BOW

BACKGROUND OF THE INVENTION

1. Field of the Invention

The present invention relates to training devices for an archery bow, and in particular, to devices for engaging the forearm of an archer.

2. Description of Related Art

An archery bow may have a substantial draw weight, that is, a substantial force required to pull the string back and fully flex the bow. This force can produce torques that change the aiming of the arrow in elevation and azimuth. Moreover, these torques will abruptly change direction at the moment the string is released to launch the arrow. For this reason, a certain amount of angular rotation of the bow can be expected and tolerated when the string is released. Specifically, when the string is released the bow normally tends to rotate in a vertical plane with its upper tip tilting forward.

Improved accuracy is achieved if the archer does not grip the bow too tightly. A tight grip tends to apply undesirable torques to the bow. In a recommended shooting method, the hand holding the bow is kept relatively open so the bow passes though the crook between the thumb and forefinger to balance primarily against the heel of the palm. This relatively open grip avoids manual torques that might tend to undesirably rotate the bow azimuthally or elevationally when aiming an arrow. Instead, the bow takes a balanced position that enhances accuracy.

Modern bows have threaded sockets for accepting a variety of accessories. For example, stabilizers in the form of cantilevered weights can be attached to the bow to balance it and to increase its moment of inertia, in order to reduce undesirable bow rotations and vibrations. Also, a string vibration arrester mounted on the bow has a rod terminating with a notched cradle for stopping a released string at a neutral position and preventing vibration.

With a compound bow the string is part of a cable system and is suspended between cams on opposite ends of the bow. When the string is pulled the cables are drawn over the cams to produce a mechanical advantage. A cable guard can be used to push the cables to the side to avoid interference with the bow string in the nock of the arrow. This cable guard can take the form of a rod screwed into a threaded socket on the bow and extending rearwardly. The affected cables can engage the guard either directly or through a slide mounted on the guard.

Any accessory attached to a bow must not interfere with the ease of use. Often, a bow must be quickly grasped and raised when hunting. A hunter does not have the time to manipulate accessories when a target suddenly comes within range.

See also U.S. Pat. Nos. 3,572,312; 3,599,621; 4,787,361; 4,836,177; 4,976,250; 5,137,008; 5,349,937; 5,464,002; 5,531,211; 5,853,000; 6,173,707; 7,748,369; and 7,954,175.

SUMMARY OF THE INVENTION

In accordance with the illustrative embodiments demonstrating features and advantages of the present invention, there is provided an accessory for an archery bow. The device has a forearm brace and a support. The forearm brace extends arcuately around a forearm axis and sized to partially encompass a forearm. The support has a distal portion that is attached to the brace and extends away from the forearm axis. The support has a proximal portion contiguous with the distal portion. The proximal portion is adapted to be supported by the bow.

In accordance with another aspect of the invention, there is provided an accessory for an archery bow. The device has a support and a rigid, C-shaped forearm brace. The brace has an arcuate slot and an inside and an outside. The brace extends arcuately around a forearm axis at least 180°. The brace is sized to partially encompass a forearm. The support has a proximal portion contiguous with a distal portion. The distal portion is attached to the outside of the brace in the arcuate slot. The distal portion extends outwardly from the brace in a direction transverse to the forearm axis. The support is adjustable to allow angular and linear translation of the forearm brace relative to an adjustment axis that is parallel to the forearm axis. The proximal portion is adapted to be supported by the bow. The distal portion of the support is circumferentially repositionable along the outside of the forearm brace. The support includes a post having a longitudinal axis and a distal end. The post has on the distal end a bearing surface skewed relative to a plane perpendicular to the longitudinal axis. The post has on opposite sides of the bearing surface a pair of walls straddling a peripheral portion of the forearm brace.

By employing an accessory of the foregoing type, an archer can achieve improved accuracy. In a disclosed embodiment a C-shaped brace is supported on its periphery by a post. The post can be perpendicularly mounted on a rod that is, in turn, attached to a threaded socket on the back of the riser of the bow. This rod can be dedicated to supporting the brace or may be part of another accessory, such as a string vibration arrester or cable guard.

In this disclosed embodiment the C-shaped brace extends 240°, has beveled tips, and is sized to encircle an archer's forearm. This forearm brace is mounted in a channel at the distal end of the post. The floor of this channel is skewed so it does not lie in a plane transverse to the post axis. This skewing is designed to tip the brace closer to the archer's forearm.

The position of the disclosed brace can be adjusted. For example, the post supporting the brace can be shifted back and forth along the rod that is attached to the bow. Thus, the forearm brace can be moved closer to or farther from the archer's wrist. Also, the post can be angularly adjusted to raise and lower the forearm brace. In this embodiment post 12 is 2 inches (5 cm) long, but different lengths may be employed in other embodiments depending upon the bowl and the archer. Also, and some embodiments, the position of the forearm brace can be adjusted by choosing an appropriate post from a set of posts of different lengths.

In the disclosed embodiment, the forearm brace can be rotated relative to the post. Specifically, the brace will have a circumferentially extending slot. A screw will extend through the slot and into a threaded hole in the floor (bearing surface) of the channel at the distal end of the post. Thus, to the extent allowed by the slot, the forearm brace can be rotated and then secured in place by tightening the screw. Accordingly, the angular position of the brace can be adjusted so it extends, for example, from the nine o'clock to five o'clock position on the forearm (from the vantage point of the archer).

When adjusted appropriately, the forearm brace rests lightly atop the archer's forearm when the bow string is drawn and the bow grip is resting against the heel of the extended hand, between the thumb and forefinger. If the extended hand inappropriately squeezes the bow, it will tip forward, lifting the forearm brace. The lifting of the brace will give the archer an indication that the grip must be changed.

Once the string is released and the arrow launched, the bow will tend to tip forward. This natural tipping will be accommodated by the forearm brace which is sufficiently open to allow unimpeded lifting of the brace and rotation of the bow.

BRIEF DESCRIPTION OF THE DRAWINGS

The above brief description as well as other objects, features and advantages of the present invention will be more fully appreciated by reference to the following detailed description of illustrative embodiments in accordance with the present invention when taken in conjunction with the accompanying drawings, wherein.

DETAILED DESCRIPTION

Figure 1:
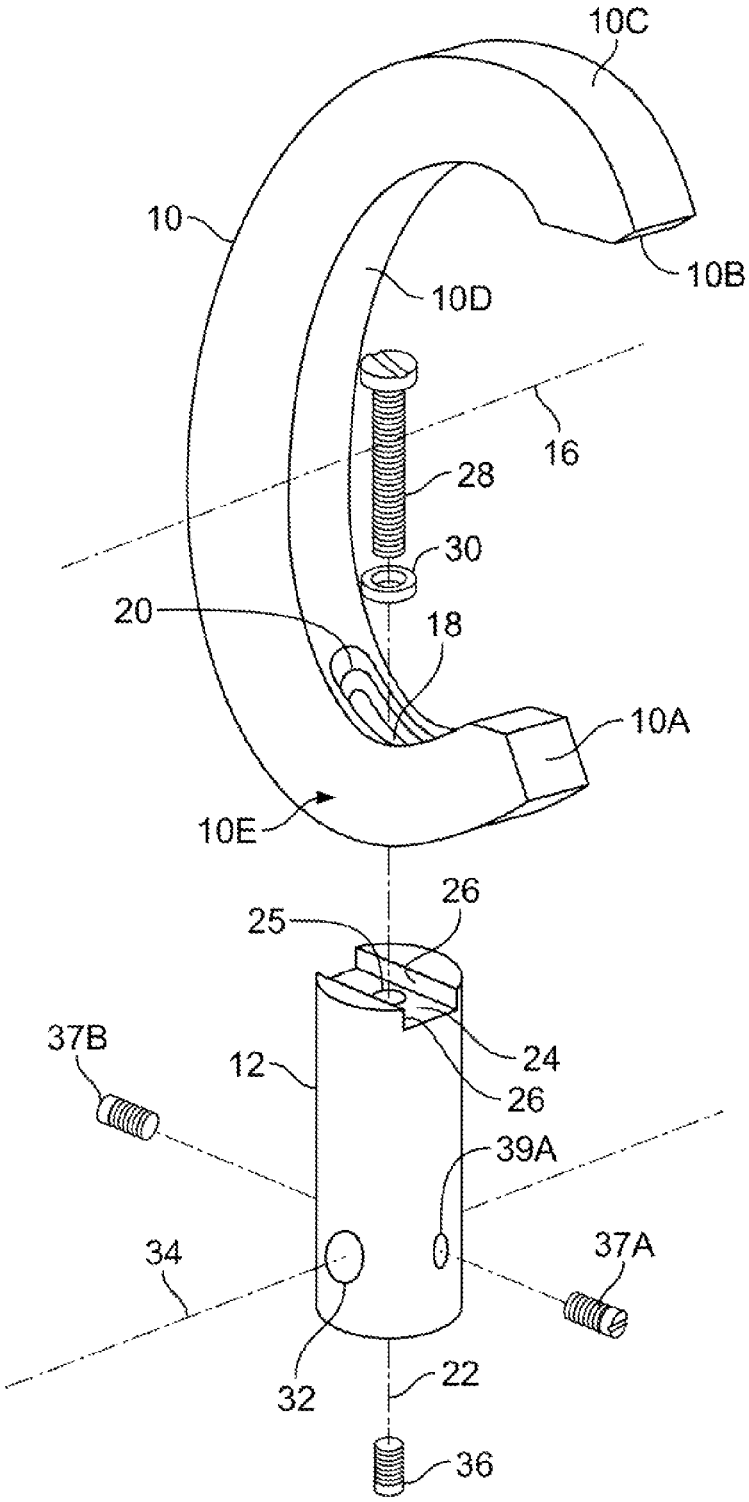
FIG. 1 is an exploded view of an accessory in accordance with principles of the present invention.
Figure 2:
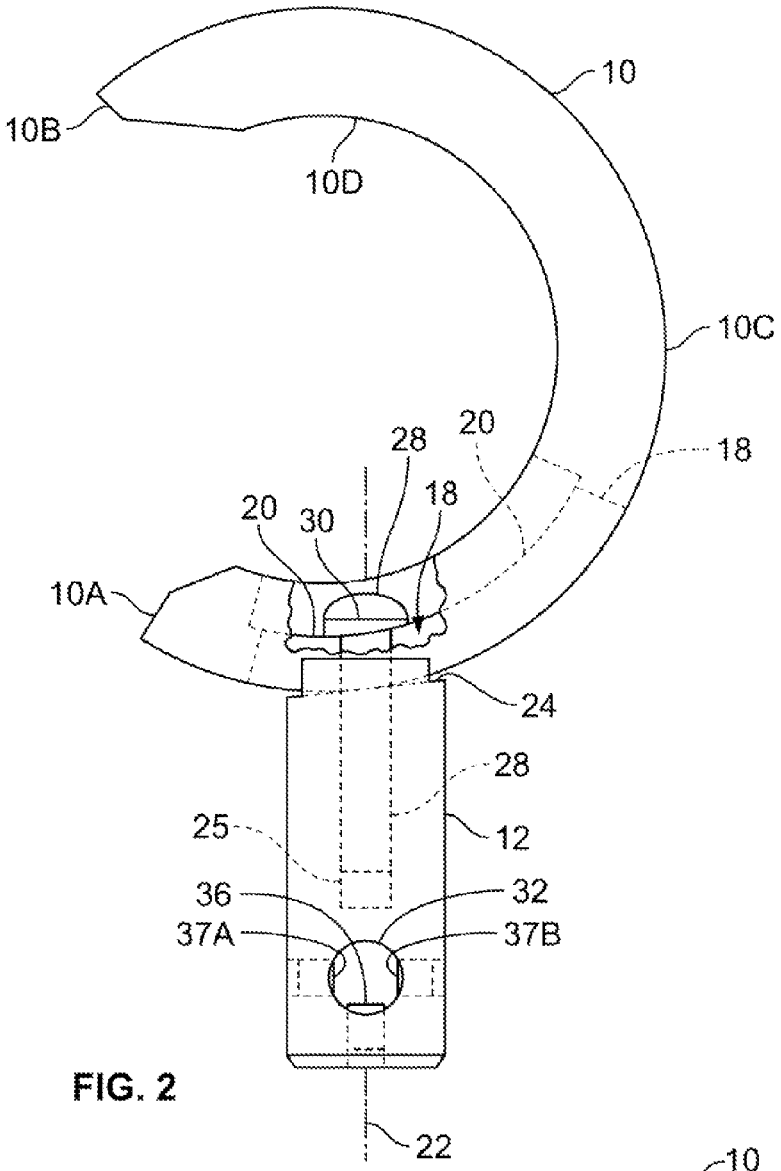
FIG. 2 is an elevational view of the device of FIG. 1, assembled.

Referring to FIGS. 1 and 2, archery bow 14 is shown with an accessory comprising forearm brace 10 mounted on support 12. Brace 10 is C-shaped and extends from bevelled tip 10A to bevelled tip 10B. Brace 10 is shown with a cylindrical inside 10D and with a cylindrical outside 10C that extends 240° around forearm axis 16, although a greater or smaller angular dimension may be employed in other embodiments. Starting approximately 15° from tip 10A, arcuate slot 18 extends circumferentially 70°. Slot 18 runs from outside 10C to inside 10D. Recess 20 on inside 10D encompasses slot 18.

Support 12 is shown as a cylindrical post with a longitudinal axis 22. The distal end of post 12 has a bearing surface 24 that is skewed approximately 7° from a plane that is perpendicular to longitudinal axis 22. Surface 24 has central threaded hole 25 and is bordered on opposite sides by parallel walls 26. Walls 26 form a channel sized to embrace forearm brace 10 at peripheral portion 10E. The wall-to-wall space of the channel is 0.5 inch (1.3 cm) and its depth is ⅛ inch (3 mm) with post 12 having a diameter of ¾ inch (1.9 cm), although these dimensions can be different in different embodiments.

Screw 28 can be inserted through washer 30 and slot 18 before being threaded into hole 25. As shown in FIG. 2 washer 30 has a bevelled face pressing against recess 20. The beveling of washer 30 accommodates the skewing of bearing surface 24. Washer 30 can be either molded into the illustrated shape or can be made from an elastomeric material that deforms into this shape when compressed by screw 28.

The proximal portion of post 12 has through bore 32 extending along adjustment axis 34, which axis is perpendicular to walls 26 and axis 22. In this specification support 12 is deemed divided into two contiguous portions, namely, a proximal portion containing bore 32 and a distal portion having the channel located between walls 26. The border between the proximal and distal portions is somewhat arbitrary and may be considered a divison into half and half, one third and two thirds, etc.

Figure 4:
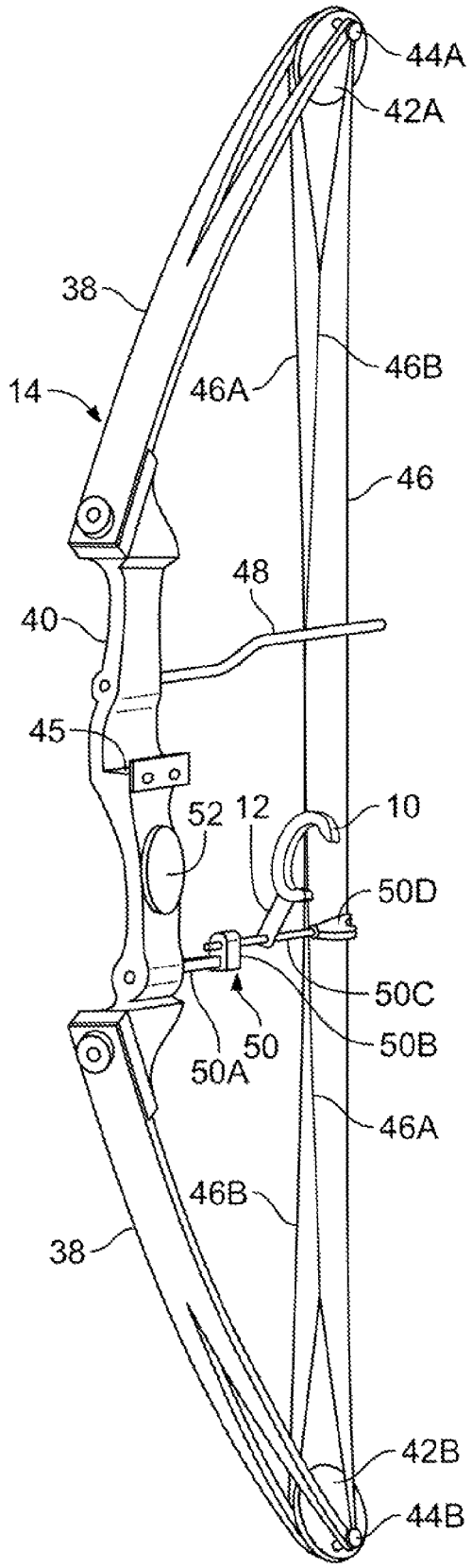
FIG. 4 is a perspective view of the device of FIG. 2 shown mounted on an archery bow.
Figure 5:
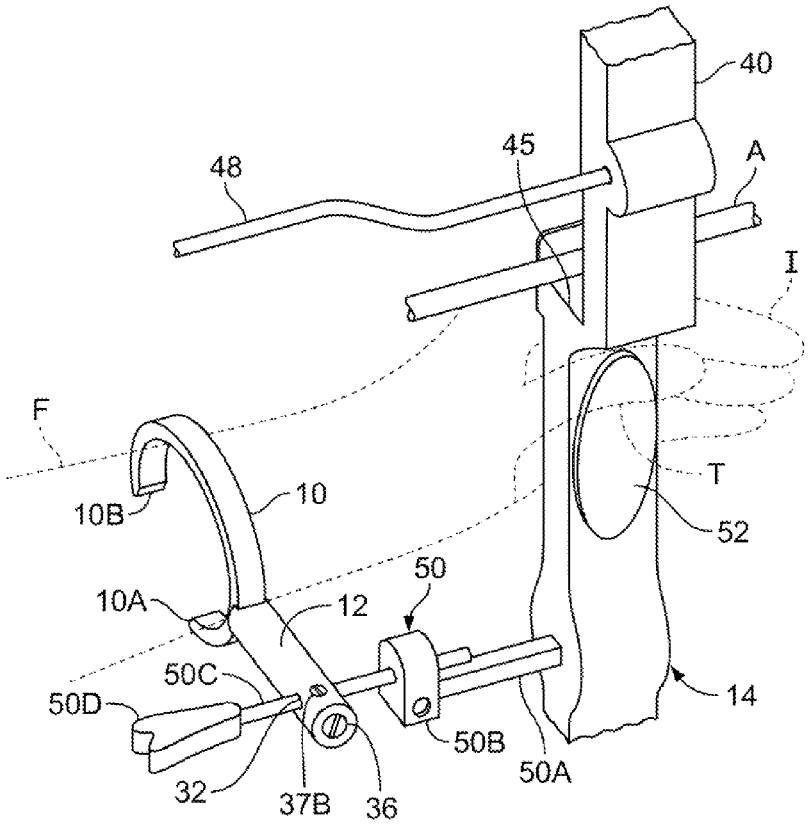
FIG. 5 is a detailed view of the assembly of FIG. 4 with portions of the bow broken away for illustrative purposes.

Referring to FIGS. 4 and 5, bow 14 has a pair of limbs 38 bolted on opposite ends of riser 40. Limbs 38 are bifurcated and rotatably support a pair of cams 42A and 42B mounted on axles 44A and 44B between the bifurcations.

Bow string 46 is routed around cam 42A and is shown descending down as cable 46A to attach through a split yoke to the ends of axle 44B. Likewise, bow string 46 is routed around cam 42B and is shown ascending as cable 46B to attach through a split yoke to the ends of axle 44A. Cable guard 48 is mounted in a threaded hole on the back of riser 40 above arrow rest 45. Guard 48 presses cables 46A and 46B to the right to avoid interference with bow string 46.

String vibration arrester 50 has a post 50A that is mounted in a threaded hole in the back of riser 40 just below hand grip 52. Clamp 50B is mounted on the distal end of post 50A and supports rod 50C. Forked rubber implement 50D is mounted on the distal end of rod 50C and is shown straddling bow string 46 in FIG. 4. Arrester 50 and guard 48 are herein referred to as rearwardly extending bow accessories.

Rod 50C is shown inserted through bore 32 of previously mentioned post 12. Rod 50C may be pulled out of clamp 50B in order to insert the rod through bore 32, before again clamping rod 50C in clamp 50B. Post 12 can linearly translate along the length of rod 50C, as well as angularly translate around the rod, before being locked into place by tightening set screws 36, 37A and 37B against rod 50C. Set screw 36 is screwed into the proximal end of post 12 through a treaded axial bore that reaches bore 32. Set screws 37A and 37B are screwed into diametrically opposed, threaded radial bores (bore 39A visible in FIG. 1) that reach bore 32. While three set screws are illustrated, some embodiments many employ one, two or another number of set screws.

To facilitate an understanding of the principles associated with the foregoing apparatus, its operation will be briefly described. An archer will grasp grip 52, placing it between thumb T and forefinger I using a relatively open grip. At the same time, the archer's forearm F will be inserted into brace 10. If brace 10 does not fit comfortably, various adjustments can be made.

To perform adjustments, set screws 36, 37A and 37B can be loosened to move brace 10 along rod 50C and thus along the length of forearm F. Also, support 12 can be rotated about rod 50C to change the elevation of brace 10. In some embodiments a collection of alternate supports will be supplied that can be longer or shorter than support 12. Accordingly, an archer can select a support having a length that positions brace 10 at a desired distance from rod 50C. Alternatively, support 12 can be fabricated as a post within a larger hollow post so that the length of the support can be telescopically adjusted.

Figure 3:
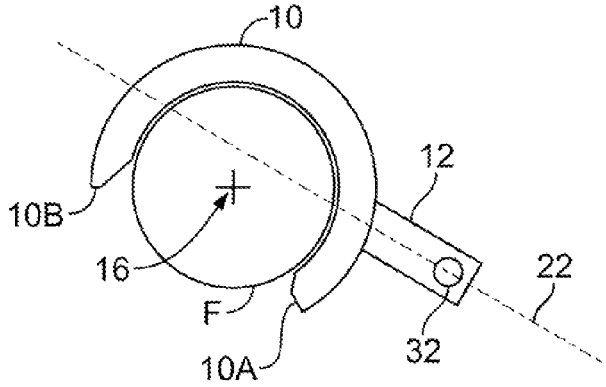
FIG. 3 is a side view of the device of FIG. 2 shown embracing an archer's forearm.

FIG. 3 shows brace 10 encircling forearm F for approximately 240°. Tip 10A is shown located at the five o'clock position and tip 10B at the nine o'clock position (viewed from the archer's vantage point). That orientation can be achieved by loosening screw 28 so it can be shifted in slot 18 in order to rotate brace 10. It will be appreciated that other orientations may be desired. In some cases the orientation may be set to extend from eight o'clock to four o'clock; 10 o'clock to six o'clock, etc. In some embodiments, brace 10 may have an angular dimension smaller than 240°, for example, 180°, 200°, 220°, etc. Also in this embodiment, brace 10 has an inside diameter of 3.0 inches (7.6 cm) and an outside diameter of 4.0 inches (10 cm), although these dimensions may be varied depending upon the size of the archer's forearm F.

When screw 28 is tightened, outside 10C is pressed against the skewed bearing surface 24. Due to this skewing, forearm axis 16 is shifted away from longitudinal axis 22, as shown in FIG. 3. This skewing is 30°±15° but can be different in other embodiments. This skewing provides the advantage of bringing the brace 10 closer to forearm F. The tilting of brace 10 caused by bearing surface 24 is accommodated by washer 30, which is tapered at an angle to accommodate the skewing of the bearing surface.

In any event, brace 10 is positioned so that forearm F can be easily inserted into and removed from the brace. Ease of use can be very important when bow 14 must be quickly raised and fired by a hunter who is responding to the arrival of a target.

With string 46 drawn and arrow A nocked and placed in rest 45, significant forces and torques will be applied to bow 14. If an archer squeezes grip 52 too tightly, bow 14 will tend to rotate in a vertical plane with the top of the bow shifting forward. However, brace 10 is arranged to encompass the top of forearm F. This feature gives positive feedback to let an archer know whether an improper grip is causing rotation of bow 14. The archer will notice such rotation because brace 10 will lift from forearm F.

When bow string 46 is released and arrow A is launched, bow 14 will naturally tend to rotate in a vertical plane with the top of the bow moving forward. Brace 10 is open and therefore accommodates this natural rotation. Basically, forearm F moves out of brace 10 as the brace moves upwardly due to rotation of bow 14.

Figure 6:
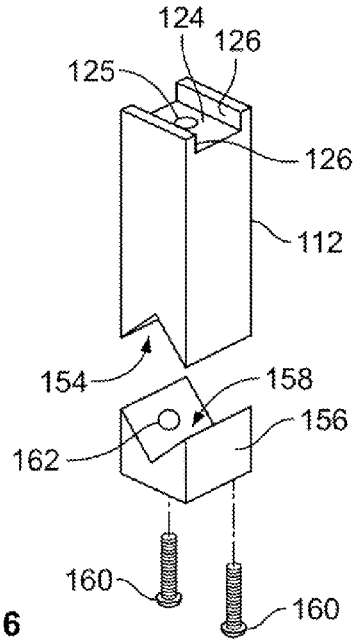
FIG. 6 is a perspective view of a support that is an alternate to that shown in FIG. 1.

Referring to FIG. 6, alternate support 112 is shown. Components corresponding to that previously illustrated for the support of FIG. 1 will bear the same reference numeral but increased by 100. Support 112 is shown as a solid rectangular prism with a V-shaped notch 154 at one end (in the proximal portion) and at the other end (in the contiguous, distal portion) a skewed bearing surface 124. Surface 124 has central threaded hole 125 and is bordered on opposite sides by parallel walls 126 and 124. Walls 26 form a channel sized to embrace forearm brace (brace 10 of FIG. 1) at peripheral portion 10E.

As before, the C-shaped brace (brace 10 of FIG. 2) can be inserted between walls 126 to bear against surface 124. The brace can be secured in place using the previously mentioned screw and washer (screw 28 and washer 30 of FIG. 2).

In this embodiment, support 112 has a clamp 156 in the form of a rectangular block with a V-shaped notch 158 facing notch 154. Clamp 156 can be secured to the body of support 112 by a pair of screws 160 that are inserted through bores 162 (only one visible in this view) before being screwed into threaded holes (not shown) in notch 154.

Previously mentioned rod (rod 50C of FIG. 5) can be inserted between notches 154 and 158 with screws 160 loosely holding clamp 156 in place. Support 112 can then be adjusted linearly and angularly before being clamped onto the rod by tightening screws 160. Notches 154 and 158 are oriented to keep the forearm axis of the brace parallel to the clamped rod.

Support 112 can be used to allow the same adjustments as previously described for the embodiment of FIG. 1. Accordingly, the brace can be positioned and used to assist an archer in the manner previously described.

It is appreciated that various modifications may be implemented with respect to the above described embodiments. While a compound bow is illustrated the present invention can be applied to various other types of bows. The dimensions can be adjusted to accommodate different bows and different archers. The disclosed support and brace can be made aluminum, steel, other metals, plastics, composite materials, etc. In some cases the brace may be flexible to yield and facilitate placing the forearm into and out of the brace. In some embodiments the inside of the brace may be padded for comfort. Also, the brace need not be circular and may be curved to ergonomically engage the forearm. Instead of using a skewed bearing surface, the support may be a rod that curves toward the forearm to bring the brace closer to the forearm. In some embodiments the support may be a flexible gooseneck or may incorporate one or more universal joints that allow spatial adjustment. The support joint may be configured as an encircling hook or as a claw with opposing teeth that fit into arcuate slots on the side of the brace. Alternatively, the brace may have an arcuate, external fin that slides in a narrow slot at the end of the support; or may have an external groove that straddles a rib at the end of the support. A support was shown using a separate V block to clamp to a rod, and likewise, similar structure can be used on the opposite end of the support to clamp to the brace.

Obviously, many modifications and variations of the present invention are possible in light of the above teachings. It is therefore to be understood that within the scope of the appended claims, the invention may be practiced otherwise than as specifically described.

The invention claimed is:

1. An accessory for an archery bow comprising:

a forearm brace extending arcuately around a forearm axis and sized to partially encompass a forearm, said forearm brace having an inside and an outside; and a support having a distal portion attached to said brace and extending away from said forearm axis, said support having a proximal portion contiguous with said distal portion, said proximal portion being adapted to be supported by said bow, said distal portion of said support being attached on the outside of said forearm brace, said distal portion of said support being circumferentially repositionable along the outside of said forearm brace.

2. An accessory according to claim 1 wherein said forearm brace has an arcuate slot, said support being fastened in said slot.

3. An accessory according to claim 1 wherein said support comprises a post having a longitudinal axis and a distal end, said post having on said distal end a bearing surface skewed relative to a plane perpendicular to said longitudinal axis.

4. An accessory according to claim 3 wherein said post has on opposite sides of said bearing surface a pair of walls straddling a peripheral portion of said forearm brace.

5. An accessory according to claim 1 wherein said forearm brace is rigid.

6. An accessory according to claim 1 wherein said forearm brace is C-shaped.

7. An accessory according to claim 1 wherein said forearm brace is rigid, said forearm brace being C-shaped.

8. An accessory for an archery bow comprising:

a forearm brace extending arcuately around a forearm axis and sized to partially encompass a forearm, said forearm brace having an inside and an outside; and a support having a distal portion attached to said brace and extending away from said forearm axis, said support having a proximal portion contiguous with said distal portion, said proximal portion being adapted to be supported by said bow, said distal portion of said support being attached on the outside of said forearm brace, said support being adjustable to allow angular and linear translation of said forearm brace relative to an adjustment axis that is parallel to said forearm axis.

9. An accessory according to claim 8 wherein said distal portion of said support extends away from said brace and transverse to said forearm axis.

10. An accessory according to claim 8 wherein said bow includes a rearwardly extending accessory, said proximal portion being adapted to be attached to said rearwardly extending accessory.

11. An accessory according to claim 10 wherein said proximal portion has a through bore sized to receive said rearwardly extending accessory.

12. An accessory according to claim 10 wherein said proximal portion has a clamp adapted to be secured to said rearwardly extending accessory.

13. An accessory for an archery bow comprising:

a forearm brace extending arcuately around a forearm axis and sized to partially encompass a forearm; and a support having a distal portion attached to said brace and extending away from said forearm axis, said support having a proximal portion contiguous with said distal portion, said proximal portion being adapted to be supported by said bow, said forearm brace extending around said forearm axis at least 180°.

14. An accessory for an archery bow comprising:

a forearm brace extending arcuately around a forearm axis and sized to partially encompass a forearm; and a support having a distal portion attached to said brace and extending away from said forearm axis, said support having a proximal portion contiguous with said distal portion, said proximal portion being adapted to be supported by said bow, said forearm brace being adjustable to extend around said forearm axis clockwise from at least a twelve o'clock to a three o'clock position, as perceived by an archer.

15. An accessory according to claim 14 wherein said forearm brace is adjustable to extend around said forearm axis clockwise from at least an eight o'clock to a four o'clock position, as perceived by an archer.

16. An accessory according to claim 14 wherein said forearm brace is adjustable to extend around said forearm axis clockwise from at least a nine o'clock to a five o'clock position, as perceived by an archer.

17. An accessory for an archery bow comprising:

a rigid, C-shaped forearm brace having an arcuate slot and an inside and an outside, said brace extending arcuately around a forearm axis at least 180°, said brace being sized to partially encompass a forearm; and a support having a proximal portion contiguous with a distal portion, said distal portion attached to the outside of said brace in said arcuate slot, said distal portion extending outwardly from said brace in a direction transverse to said forearm axis, said support being adjustable to allow angular and linear translation of said forearm brace relative to an adjustment axis that is parallel to said forearm axis, said proximal portion being adapted to be supported by said bow, said distal portion of said support being circumferentially repositionable along the outside of said forearm brace, said support comprising a post having a longitudinal axis and a distal end, said post having on said distal end a bearing surface skewed relative to a plane perpendicular to said longitudinal axis, said post having on opposite sides of said bearing surface a pair of walls straddling a peripheral portion of said forearm brace.

* * * * *